United States Patent [19]

Tupper et al.

[11] Patent Number: 5,071,325

[45] Date of Patent: Dec. 10, 1991

[54] COMBINATION PRIMER AND MIXTURE ENRICHMENT DEVICE

[76] Inventors: Willis E. Tupper, 11865 Durston, Pinckney, Mich. 48169; Donald A. Koengeter, 2020 S. Lima Center, Chelsea, Mich. 48118

[21] Appl. No.: 499,049

[22] Filed: Mar. 26, 1990

[51] Int. Cl.[5] ..... F04B 21/02; F04B 39/10

[52] U.S. Cl. ..... 417/496; 137/556; 251/297; 417/63; 417/497; 417/571

[58] Field of Search ..... 137/556; 251/297; 417/63, 496, 497, 571

[56] References Cited

U.S. PATENT DOCUMENTS

| | | | |
|---|---|---|---|
| 1,190,539 | 7/1916 | Georgenson | 417/496 |
| 1,240,404 | 9/1917 | Aull | 417/496 |
| 1,396,529 | 11/1921 | Rudolph | 417/496 |
| 1,457,033 | 5/1923 | Jorgensen et al. | 417/496 |
| 2,345,663 | 4/1944 | Franck | 417/496 |
| 2,424,595 | 7/1947 | Warren . | |
| 2,537,241 | 1/1951 | Smith . | |
| 2,662,723 | 12/1953 | Coffey | 251/119 |
| 2,690,278 | 9/1954 | Bacheller | 222/207 |
| 3,090,596 | 5/1963 | Gifford | 251/357 X |
| 3,153,381 | 10/1964 | Holley, Jr. | 103/44 |
| 3,159,176 | 12/1964 | Russell et al. | 137/493.1 |
| 3,165,120 | 1/1965 | Horowitz | 251/297 X |
| 3,434,808 | 3/1969 | Pobst, Jr. | 23/314 |
| 3,469,528 | 9/1969 | East . | |
| 3,527,551 | 9/1970 | Kutik et al. | 417/560 |
| 3,591,316 | 7/1971 | Piccirilli | 417/364 |
| 3,664,774 | 5/1972 | Tupper | 417/560 |
| 3,676,026 | 7/1972 | Tupper | 417/560 |
| 3,803,988 | 4/1974 | Orr | 92/85 |
| 3,983,857 | 10/1976 | O'Connor | 123/187.5 |
| 4,189,064 | 2/1980 | O'Neill et al. | 222/321 |
| 4,370,107 | 1/1983 | Landis et al. | 417/413 |
| 4,660,516 | 4/1987 | Baltz et al. | 123/187.5 |
| 4,684,484 | 8/1987 | Guntly | 261/35 |
| 4,735,751 | 4/1988 | Guntly | 261/35 |
| 4,776,776 | 10/1988 | Jones | 417/560 |
| 4,862,847 | 9/1989 | Kobayashi et al. | 123/187.5 |

FOREIGN PATENT DOCUMENTS

| | | | |
|---|---|---|---|
| 162712 | 5/1955 | Australia | 417/63 |
| 875142 | 4/1953 | Fed. Rep. of Germany . | |
| 560076 | 3/1957 | Italy . | |

*Primary Examiner*—Gerald A. Michalsky
*Attorney, Agent, or Firm*—Krass & Young

[57] ABSTRACT

The present invention is a fuel primer pump capable of manually injecting fuel into the carburetor of an internal combustion engine, and is adapted to include both enrichment and shut-off positions. The primer pump includes a housing sealed at one end by an end cap which defines inlet and outlet openings. An internal piston is disposed within the housing for manual pumping of fuel. A relatively free floating valve pin, mounted on the internal piston, prevents an unwanted flow of fuel through the primer pump when the pump is disposed in the shut-off position. The valve pin is slidably retained within a cavity in the piston which opens onto the face of the piston proximate the end cap defining the outlet passageway. The valve pin is spring biased toward the outlet passageway and centers itself in the passageway seat due to the free floating nature thereof. The valve pin becomes disengaged from the seat when the primer pump is placed in the enrichment position, allowing the flow of fuel through the primer pump. Check valve assemblies communicating with the inlet and outlet openings operate to produce a flow of fuel to the carburetor during manual operation of the primer pump.

14 Claims, 4 Drawing Sheets

COMBINATION PRIMER AND MIXTURE ENRICHMENT DEVICE

BACKGROUND OF THE INVENTION

The present invention relates to an improved fuel primer pump and mixture enrichment device adapted particularly for use with the fuel system of a two-cycle gasoline engine.

FIELD OF THE INVENTION

Two-cycle gasoline engines, used in snowmobiles, snow blowers and the like, typically include a fuel enrichment device in the fuel system to provide enriched fuel mixtures for starting purposes and selective enrichment under certain operating conditions. A manually operable fuel primer pump provides a secondary fuel route to the engine. Such fuel pumps generally are designed to provide an additional flow of fuel when necessary. However, during quick deceleration, the engine creates a vacuum which tends to draw unwanted fuel through existing primer pump designs. This vacuum causes excess fuel to flow to the carburetor, often stalling the engine. It is known to provide check valves in the fuel system to overcome this problem. Such a system is disclosed in U.S. Pat. No. 3,676,026, to Tupper, et al, for a primer pump. Such check valves generally include a ball element positioned to block the unwanted flow of fuel by a compression spring. It has been found that the compression spring may, however, be overcome by the engine vacuum. Another example of a check valve is disclosed in U.S. Pat. No. 3,664,774, to Tupper, et al, for a primer pump. This check valve utilizes a molded diaphragm element to provide a seal, which is difficult to manufacture and must be frequently replaced due to wear.

There thus exists a need to provide an improved fuel primer pump which includes an efficient means to prevent the undesirable flow of fuel during deceleration.

SUMMARY OF THE INVENTION

The present invention relates to a fuel primer pump for use with internal combustion engines capable of manually injecting fuel along a secondary fuel route. The fuel pump is capable of maintaining a closed or shut-off position preventing the flow of fuel and an open or enrichment position allowing the flow of fuel.

The fuel primer pump comprises a pump housing defining an internal pump chamber. An end cap covers one end of the housing and include a pair of ports for inlet and outlet of fluid. Both ports have free-floating check valve assemblies operating to prevent the flow of liquid in a direction opposite the natural flow of the inlet and outlet ports. A piston element is disposed within the internal chamber of the housing to provide means for manual pumping of fluid through the primer pump. The piston element connects to a handle element protruding through the end of the housing opposite the end cap. Movement of the handle causes the piston element to slide within the housing enlarging or reducing a fluid chamber defined therein.

The piston element includes a relatively free-floating valve pin projecting toward an internal passageway in the end cap which connects to the outlet port. The piston element is spring biased to assume the closed position. The valve pin projects from the forward face of the piston element. To provide optimum sealing characteristics, the valve pin is slidably disposed within a cavity opening on the forward face of the piston element and is spring biased toward the end cap. The valve pin includes a rubber tip sealing portion which engages the mouth of the outlet passageway when said piston element is placed in the closed or shut-off position.

The handle element includes an enrichment position indicator ring which is hidden from view in the shut-off position and exposed to view when the handle is pulled to the enrichment position. The handle also includes a lock ring disposed to engage an edge of the housing to overcome the force of the spring biasing the piston toward a closed configuration when the pump is placed in the enrichment position. The lock ring prevents unintentional movement of the pump handle, which would reduce the efficiency of the machine, when placed in the enrichment position.

BRIEF DESCRIPTION OF THE DRAWINGS

These and other objects and aspects of the present invention will become clear from the following description of the invention, in which.

DESCRIPTION OF THE PREFERRED EMBODIMENT

Figure 1:
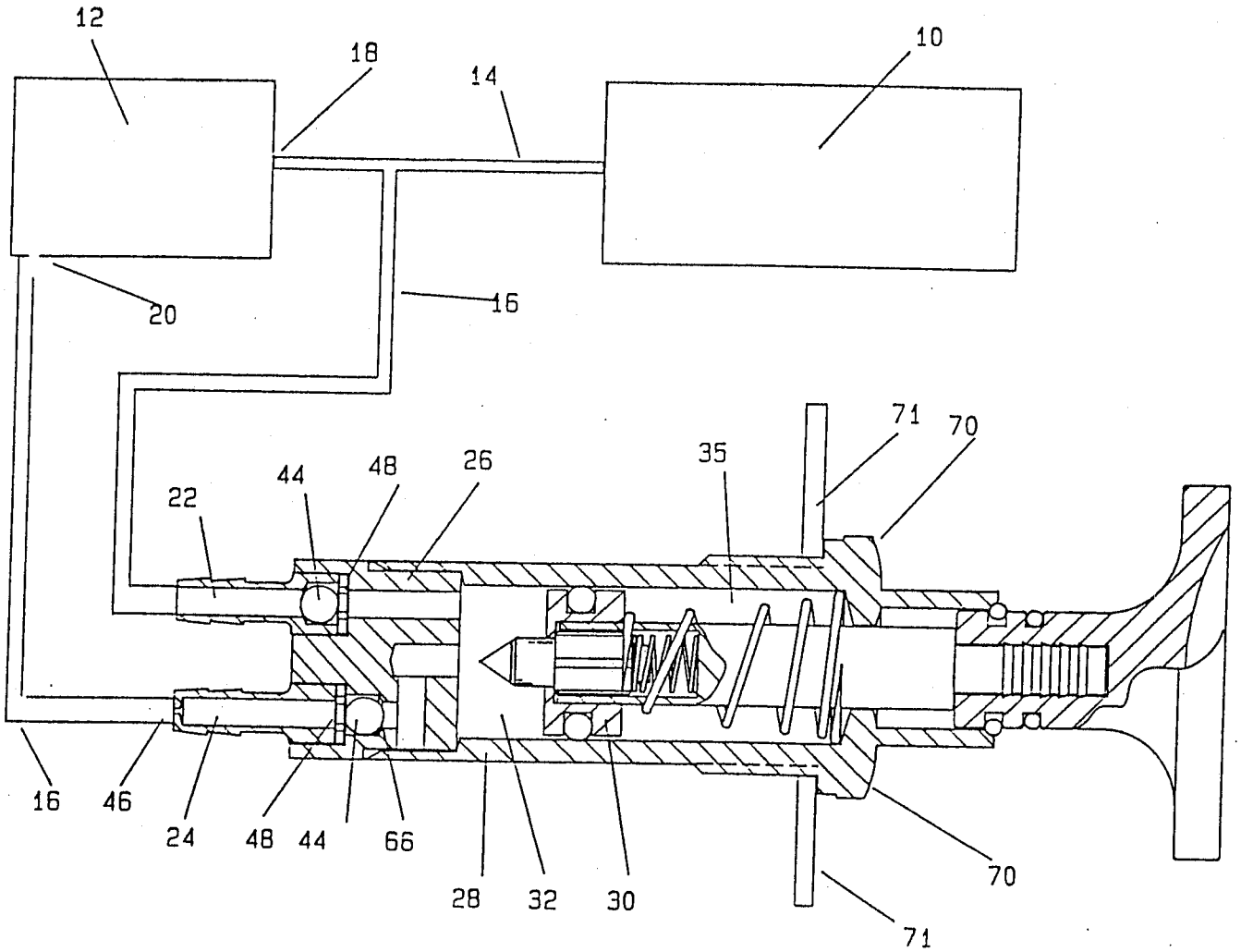
FIG. 1 illustrates in block drawing the present invention as it relates to a fuel system.

With reference to FIG. 1, the present invention comprises a fuel primer pump 8 used in conjunction with the primary fuel system of an internal combustion engine device. Typically, the fuel tank 10 and engine carburetor 12 are connected by a primary fuel line 14. Secondary lines 16 tap fuel flow to the primer pump 8 from the fuel tank 10 and thereafter attach to the carburetor 12. This provides the carburetor 12 with a primary fuel inlet 18 and a potential secondary fuel inlet 20.

The housing 28 can be configured to have any of a variety of protrusions 70 to mount the primer pump 8 on any given device utilizing an internal combustion engine. Typically, the primer pump 8 is mounted on a fascia, such as an instrument panel 71.

The fuel primer pump 8 includes a housing 28 covered at one end by end cap 26. An inlet fitting 22 and an outlet fitting 24 are mounted on the end cap 26. Except for the openings for pair of fittings 22, 24, the end cap 26 effectively seals this end of housing 28. Further, the combination of the end cap 26, housing 28 and piston element 30 cooperate to form an internal fluid chamber 32 defined within a portion of the overall internal pump Chamber 35. The size of the internal fluid chamber 32 therefore depends upon the position of the piston element 30 within housing 28.

A) The Enrichment Position

Figure 2:
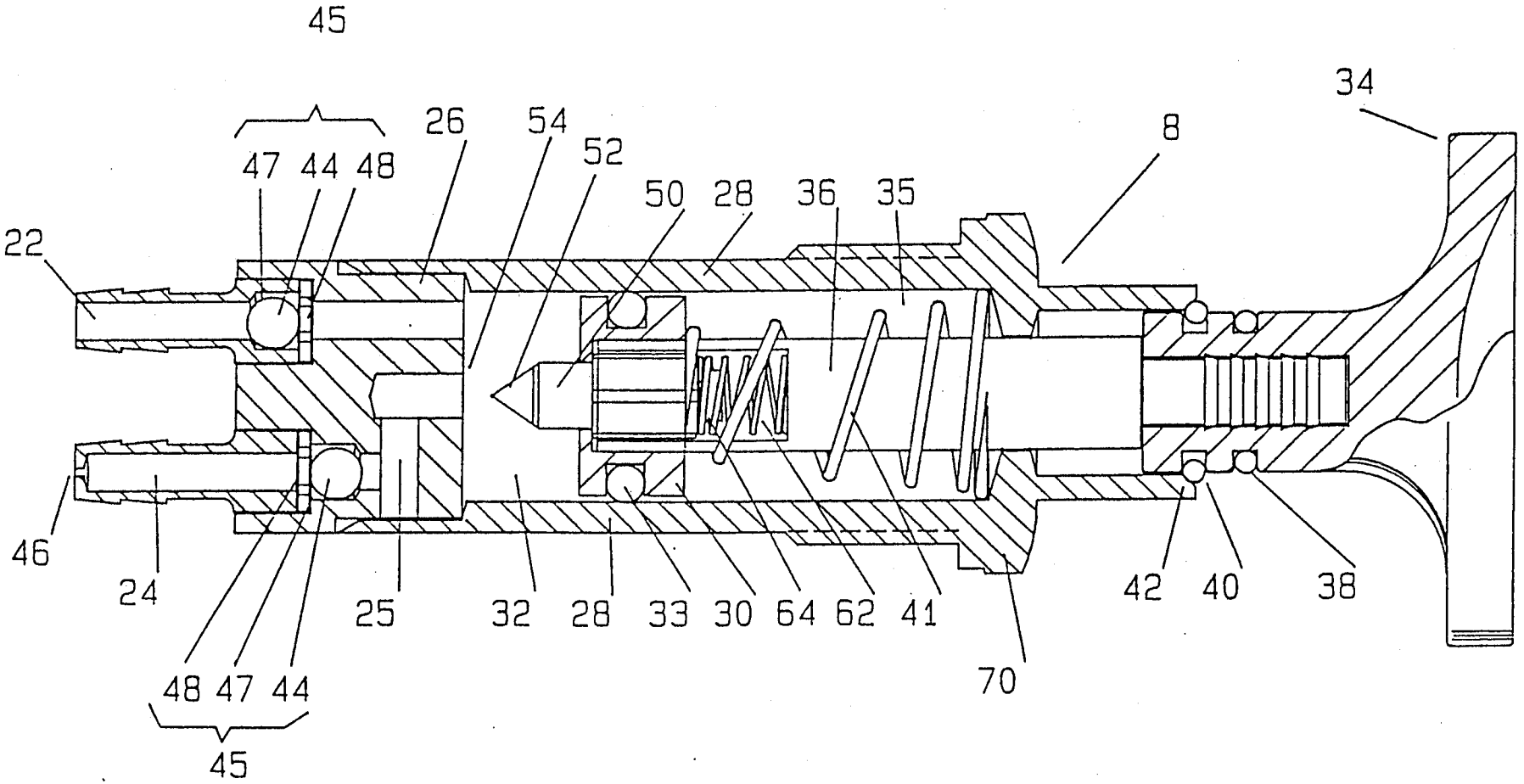
FIG. 2 illustrates the present invention in cross-section when placed in the enrichment position.

With reference now to FIG. 2, the primer pump 8 is shown in the enrichment position. Movement of handle element 34 rearward causes the piston element 30, sealed by o-ring 33, to slide correspondingly rearward. Handle 34 connected by the attachment rod 36 to the piston element 30 controls the movement of a piston element 30. To place the primer pump 8 in the enrichment position, the piston element 30 is moved rearward which retracts valve pin 50 from valve seat 54, thereby opening a path for relatively unrestricted flow of fuel from inlet fitting 22 through the internal fluid chamber 32 to outlet fitting 24. When disposed in this enrichment position, indicator ring 38 becomes visible and lock spring 40 engages the tapered edge 42 of housing 28 retaining the primer pump in the enrichment configuration. The force of the compressed internal spring 41, which biases the slidable movement of piston element 30 toward a closed configuration, is overcome by the lock spring 40. When disposed in this position, check valve balls 44 float freely in valve cavities 47 of the check valve assembly 45 allowing passage of fluid through the inlet fitting 22 and outlet nozzle 24. The rate of fluid flow is determined by the relative constricture of the passageways such as at metered outlet opening 46 or multi-holed washers 48 disposed within the check valve assembly 45, and the intake manifold vacuum of the running engine. The check valve assemblies 45 will be disclosed in detail hereinafter.

B) The Shut-Off Position

Figure 4:
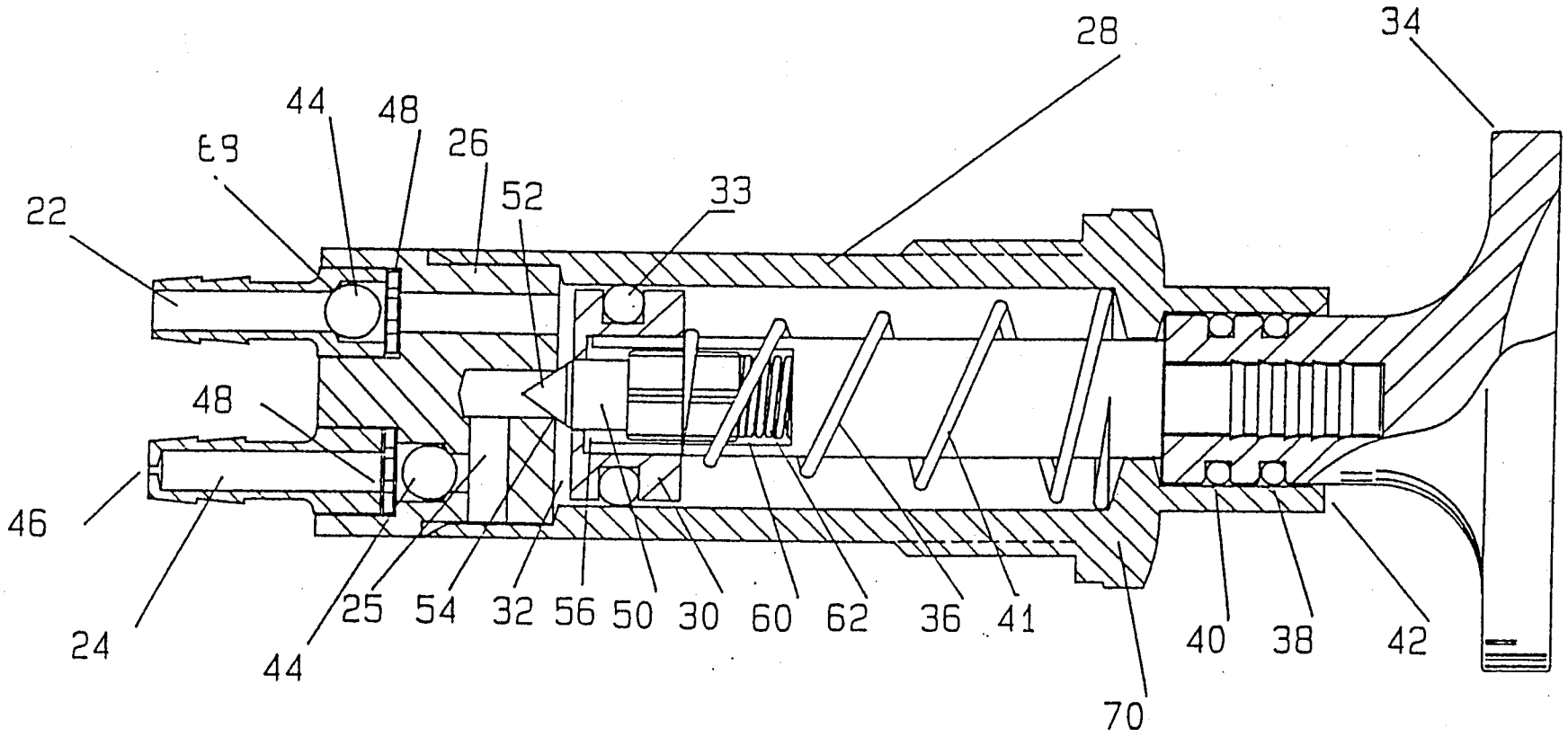
FIG. 4 is a cross-section diagram of the present invention when disposed in the shut-off position.

With reference now to FIG. 4, the present invention further has a positive shut-off position which prevents the flow of fluids through the primer pump 8. The piston element 30 is positioned forward in housing 28 in this shut-off position. Motion of the handle 34 toward end cap 26, disengages lock ring 40 and conceals the indicator ring 38 within housing 28. The force associated with spring 41 biases the piston 30 toward end cap 26. A relatively free-floating valve pin 50 slidably disposed within the piston element 30 engages the outlet passageway 25 which connects the outlet fitting 24 to the interior fuel chamber 32.

Figure 3:
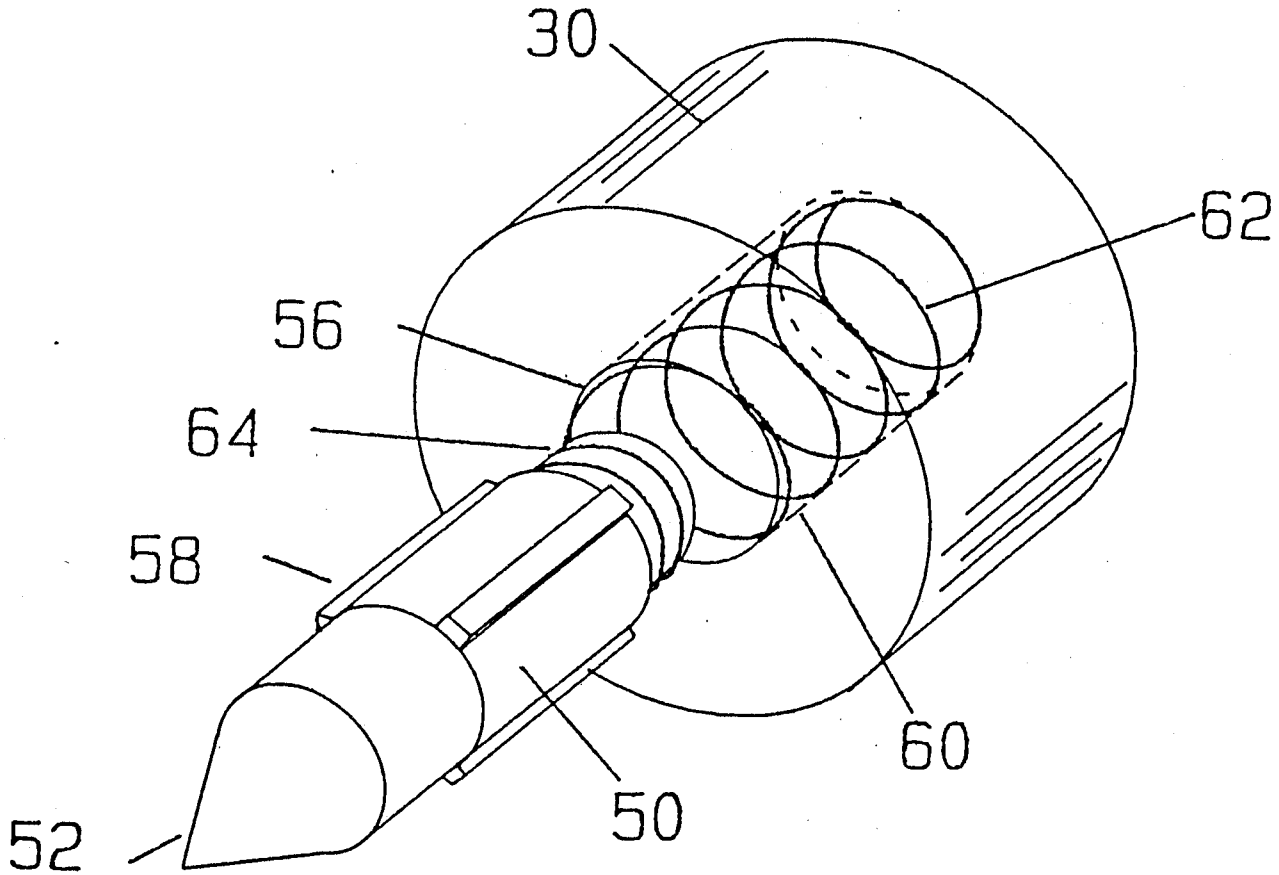
FIG. 3 is a perspective drawing of the piston and valve pin elements.

With reference to FIGS. 2, 3, and 4, the valve pin 50 includes a rubber covered, tapered tip section 52 configured to engage the seat 54 associated with passageway 25. The valve pin 50 floats relatively freely within pin opening 56 of piston element 30. The valve pin 50 includes a plurality of fins 58 which bear upon the inside surface 60 of the cavity of pin opening 56 to further position the pin 50 within the opening 56. A spring 62 secured and disposed within the pin opening 56 engages the pin 50 at spring engagement section 64 to retain the valve pin 50 within opening 56 and bias the pin 50 toward the end cap 26. Tolerances between valve pin 50 and pin opening 56 create a measure of movement allowing the tapered tip section 52 of valve pin 50 to center itself within seat 54 to accommodate for valve pin wear. The rubber covered tip section 52 engages seat 54 on the inside of primer pump 8 to seal the outlet passageway 25 at the end most distant the carburetor 12. Thus, a vacuum created by the engine tends to strengthen the seal, instead of breaking the seal and causing an unwanted flow of fuel.

C) Manual Priming

A further use of the primer pump 8 is to manually produce a flow of fuel into the carburetor for starting purposes. When the piston element 30 is pulled rearward by handle 34, an intake stroke results and the check valve assemblies 45 operate to draw fuel from the fuel tank 10. The check valve balls 44 are drawn rearward by the force of suction of the piston element 30 moving within chamber 28. This causes the check valve ball 44 associated with the check valve assembly 45 communicating with the outlet fitting 24 to be drawn into tapered section 66 sealing the outlet from a backwards flow of fuel. The check valve assembly 45 associated with the intake fitting 22 allows fuel to be drawn into internal fuel chamber 32 through the intake port 22. The ball 44 is drawn against multi-holed washer 48 maintaining an open pathway through the check valve assembly 45.

On movement of the handle 34 forward which produces an output stroke, the check valve assemblies 45 operate to direct fluid drawn into internal fluid chamber 32 through the output fitting 24 and not through input fitting 22. As can be seen in FIG. 4, the forward motion of the piston element 30 produces a pressure upon both check valve balls 44 moving them forward in their respective check valve assemblies. This causes the check valve assemblies to operate in the reverse of the previously described intake stroke. Check valve ball 44 of the intake fitting 22 seats in the tapered opening 68 sealing the intake fitting 22 against the flow of fluid, and further causes check valve ball 44 of the output fitting 24 to be disposed against multi-holed washer 48 which allows fluid to flow through output passageway 25.

D) Operation

The present invention is typically utilized in several ways during the course of starting and running the associated engine. Initially, the primer pump 8 is manually operated to produce a substantial flow of fuel into the carburetor 12 before the engine is started. The engine uses this initial fuel supply for starting. Once the engine is operating, the primer pump 8 is placed in its enrichment position. In this position, the engine draws fuel through the primer pump 8 due to the natural vacuum developed by the engine intake manifold providing a secondary avenue for fuel, supplementing the primary fuel system. The enrichment position is typically utilized until the engine reaches its specified operating temperature, at which point the engine no longer needs a supplemental flow of fuel. Thereafter, the primer pump 8 is placed in a positive shut-off position. In this position, the secondary flow of fuel ceases since engine vacuum strengthens the seal which obstructs fuel flow through the primer pump 8.

Having thus described my invention, it can be seen that numerous alternative configurations can be envisioned without departing from the spirit of this invention.

I, therefore, claim:

1. A fuel pump assembly, having a first shut-off position and a second enrichment position, comprising:

a housing defining an internal chamber;

an inlet passageway communicating with said internal chamber;

an outlet passageway communicating with said internal chamber;

a piston slidably disposed within said internal chamber;

a handle element configured to manually move said piston within said internal chamber;

valve seat means disposed between said outlet passageway and said internal chamber;

a spring disposed within said housing adapted to bias said piston toward said valve seat means;

valve closure means disposed on said piston, said closure means positively engaging said valve seat means in said first shut-off position, restricting flow of said fuel from said internal chamber to said outlet passageway, and said valve closure means being disengaged from said valve seat means in said second enrichment position permitting flow of said fuel from said chamber to said outlet passageway; and a lock spring disposed on said handle element which engages an edge of said housing when said pump assembly is disposed in said second enrichment position, said lock spring being of sufficient strength to overcome the biasing force of said spring disposed within said housing, thereby retaining said piston against unintentional movement.

2. The assembly of claim 1, wherein said valve closure means disposed on said piston includes a valve pin projecting toward said valve seat means.

3. The assembly of claim 2, wherein said pin is slidably disposed within a central cavity in said piston, said pin further being spring biased toward said valve seat means.

4. The assembly of claim 3, wherein said pin includes a tip section comprising an elastomeric material.

5. The assembly of claim 1, wherein said handle element further includes a visible indicator identifying said second enrichment position.

6. The assembly of claim 1, wherein said inlet passageway includes a free-floating check valve configured to allow the flow of said liquid into said internal chamber, and further configured to prevent the flow of said liquid out of said internal chamber, said check valve comprising a ball disposed within a cavity between a first opening defined by a multi-holed washer and a second opening adapted to be sealed by said ball, said first opening being positioned proximate to said internal chamber.

7. The assembly of claim 1, wherein said outlet passageway includes a free-floating check valve configured to allow the flow of said liquid out of said internal chamber and further configured to prevent the flow of said liquid into said internal chamber, said check valve comprising a ball disposed within a cavity between a first opening defined by a multi-holed washer and a second opening adapted to be sealed by said ball, said first opening being positioned distally from said internal chamber.

8. A fuel pump assembly, having a first shut-off position and a second enrichment position, comprising:

a housing defining an internal chamber;

an inlet passageway communicating with said internal chamber;

an outlet passageway communicating with said internal chamber;

a plunger assembly at least a portion of which is slidably disposed within said internal chamber, said plunger assembly including a piston element slidably retained in said internal chamber, said piston element further containing a valve pin cavity, said plunger assembly further including a handle element configured to manually move said piston element within said internal chamber;

valve seat means disposed between said outlet passageway and said internal chamber;

a spring disposed within said housing adapted to bias said plunger assembly toward said valve seat means;

a valve pin member slidably disposed within said valve pin cavity and biased toward said valve seat means, and further disposed to positively engage said valve seat means in said first shut-off position, whereby said valve pin restricts the flow of said fuel from said internal chamber to said outlet passageway by automatically centering in said valve seat means in said first shut-off position, said valve pin member being disengaged from said valve seat means when said pump assembly is disposed in said second enrichment position; and a lock spring disposed on said handle element which engages an edge of said housing when said pump assembly is disposed in said second enrichment position, said lock spring being of sufficient strength to overcome the biasing force of said spring disposed within said housing, thereby retaining said plunger assembly against unintentional movement.

9. The assembly of claim 8, wherein said handle element further includes a visible indicator identifying said second enrichment position.

10. The assembly of claim 8, wherein said inlet passageway includes a free-floating check valve configured to allow the flow of said liquid into said internal chamber, and further configured to prevent the flow of said liquid out of said internal chamber, said check valve comprising a ball disposed within a cavity between a first opening defined by a multi-holed washer and a second opening adapted to be sealed by said ball, said first opening being positioned proximate to said internal chamber.

11. The assembly of claim 8, wherein said outlet passageway includes a free-floating check valve configured to allow the flow of said liquid out of said internal chamber and further configured to prevent the flow of said liquid into said internal chamber, said check valve comprising a ball disposed within a cavity between a first opening defined by a multi-holed washer and a second opening adapted to be sealed by said ball, said first opening being positioned distally from said internal chamber.

12. The assembly of claim 8, wherein said pin includes a tip section comprising an elastomeric material.

13. The assembly of claim 8, wherein said valve pin is biased toward said valve seat means by a valve spring disposed within said valve pin cavity and engaging said valve pin.

14. A pump assembly for liquids having a first shut-off position and a second enrichment position, comprising:

a housing defining an internal chamber;

an inlet passageway communicating with said internal chamber, said inlet passageway including a check valve, said check valve being configured to allow the flow of said liquids into said internal chamber and further configured to prevent the flow of said liquid out of said internal chamber, said check valve comprising a ball disposed within a cavity between a first opening defined by a multi-holed washer and a second opening adapted to be sealed by said ball, said first opening being positioned proximate to said internal chamber;

an outlet passageway communicating with said internal chamber, said outlet passageway including a check valve, said check valve being configured to allow the flow of said liquids into said internal chamber and further configured to prevent the flow of said liquid out of said internal chamber, said check valve comprising a ball disposed within a cavity between a first opening defined by a multi-holed washer and a second opening adapted to be sealed by said ball, said first opening being positioned distally from said internal chamber;

a plunger assembly, said plunger assembly including a piston element slidably disposed within said internal chamber, and a handle element configured to manually move said piston element with said internal chamber, said piston element further defining a valve pin cavity;

valve seat means disposed between said outlet passageway and said internal chamber;

a spring disposed within said housing adapted to bias said plunger assembly toward said valve seat means;

said handle element further including a lock spring which engages an edge of said housing when said pump assembly is disposed in said second enriched position, said lock spring being of sufficient strength to overcome the biasing force of said spring disposed within said housing; and valve pin member slidably disposed within said valve pin cavity and spring biased toward said valve seat means, said valve pin member having a tip section disposed to positively engage said valve seat means in said first shut-off position thereby restricting the flow of said liquids from said internal chamber to said outlet passageway, and said tip section comprising an elastomeric material, said valve pin member being disengaged from said valve seat means when said pump assembly is disposed in said second enriched position.

* * * * *